US007163427B1

(12) United States Patent
Lee

(10) Patent No.: US 7,163,427 B1
(45) Date of Patent: Jan. 16, 2007

(54) TROLLING MOTOR DEVICE

(76) Inventor: Bruce R. Lee, 19507 Ware Creek Rd., Rappahannock Academy, VA (US) 22538

( * ) Notice: Subject to any disclaimer, the term of this patent is extended or adjusted under 35 U.S.C. 154(b) by 0 days.

(21) Appl. No.: 11/341,506

(22) Filed: Jan. 30, 2006

(51) Int. Cl.
*B60L 11/02* (2006.01)

(52) U.S. Cl. ..... 440/6

(58) Field of Classification Search ..... 440/6
See application file for complete search history.

(56) References Cited

U.S. PATENT DOCUMENTS

| | | | | |
|---|---|---|---|---|
| 2,902,967 | A | 9/1959 | Wanzer | |
| 3,861,628 | A | 1/1975 | Kreiger | |
| 3,870,258 | A | 3/1975 | Shimanckas et al. | |
| 3,915,417 | A | 10/1975 | Norton et al. | |
| 3,930,461 | A | 1/1976 | Brock et al. | |
| 3,948,204 | A | 4/1976 | Brock et al. | |
| 4,129,088 | A | 12/1978 | Foley, Jr. | |
| 4,154,417 | A | 5/1979 | Foley, Jr. | |
| 4,555,233 | A | 11/1985 | Klammer et al. | |
| 4,668,195 | A | 5/1987 | Smith | |
| 4,734,066 | A | 3/1988 | Burgess | |
| 4,735,166 | A | 4/1988 | Dimalanta | |
| 5,112,258 | A | 5/1992 | Folsom | |
| 5,129,845 | A | 7/1992 | Henderson | |
| 5,169,349 | A * | 12/1992 | Hilbert | 440/6 |
| 5,331,914 | A | 7/1994 | Salmons | |
| 5,580,287 | A | 12/1996 | Wieringa | |
| 6,213,821 | B1 | 4/2001 | Bernloehr et al. | |
| 6,431,923 | B1 * | 8/2002 | Knight et al. | 440/6 |

* cited by examiner

*Primary Examiner*—Stephen Avila
(74) *Attorney, Agent, or Firm*—William L. Klima; Klima Law Offices, PLLC

(57) ABSTRACT

A trolling motor device including a variable length drive unit to assist in moving the trolling motor device in and out of the water. Preferably, the drive unit is both extended/retracted while being pivoted to increase the speed of deployment or stowage.

18 Claims, 5 Drawing Sheets

TROLLING MOTOR DEVICE

FIELD OF THE INVENTION

The present invention is directed to a trolling motor device, in particular, a bow trolling motor device having an extendable/retractable or telescoping drive unit.

BACKGROUND OF THE INVENTION

Currently, there exist a number of electric powered trolling motors for use with small boats, in particular fishing or bass boats. Typically, the trolling motor is mounted on top of the deck at or adjacent the bow of the fishing or bass boat.

The conventional trolling motor includes a mounting plate, which is fastened to the deck of the boat. The drive unit is pivotably connected to the mounting unit so that the drive unit can be lifted upward out of the water and pivoted by a pull cord connected to the mounting unit so that the drive unit lays down flat on top of the deck of the boat for storage. To place the drive unit back in the water, the user again pulls upwardly on the pull cord to lift and pivot the drive unit down into the water.

The drive unit includes an upper steering unit connected to an upper end of a fixed length support shaft, and a lower drive unit connected to a lower end of the same shaft. The shaft is pivotably mounted to the mounting unit.

An electric battery (e.g. 6 volt, 12 volt, 24 volt, 36 volt) is electrically connected to a foot pedal control unit mounted on the top of the deck of the fishing or bass boat. A control cable extends from the foot pedal control unit to the upper steering unit of the drive unit. The foot pedal control unit controls both the steering of the drive unit, off/on of the drive unit, forward/reverse of the drive unit, and the power level of the drive unit.

SUMMARY OF THE INVENTION

A first object of the present invention is to provide an improved trolling motor device.

A second object of the present invention is to provide an improved bow trolling motor device.

A third object of the present invention is to provide an improved trolling motor device with an extendable/retractable drive unit.

A fourth object of the present invention is to provide a trolling motor device with a telescoping drive unit.

A fifth object of the present invention is to provide a trolling motor device with an improved mounting unit.

A sixth object of the present invention is to provide an improved trolling motor device with improved drive unit.

A seventh object of the present invention is to provide an improved trolling motor device with an improved drive unit housing.

An eighth object of the present invention is to provide an improved trolling motor device including a drive unit with steering combined with being extendable/retractable or telescoping.

The present invention is directed to an improved trolling motor device, in particular an improved bow trolling motor device. The trolling motor device includes the combination of a mounting unit and a drive unit. Preferably, the drive unit is pivotably connected to the mounting unit.

The mounting unit is configured to be mounted on top of the deck of the fishing or bass boat. For example, the mounting unit includes a mounting plate to be fastened to the deck of the fishing or bass boat, for example, the mounting plate is provide with through holes for accommodating fasteners (e.g. screws) for securely attaching the mounting plates on top of the front deck at or adjacent the bow of the fishing or bass boat.

The drive unit includes an upper steering unit and a lower drive unit. A drive unit housing connects the upper steering unit to the lower drive unit.

The trolling motor device according to the present invention is preferably a bow trolling motor device to be mounted or installed at or adjacent to the bow of the boat, in particular on the upper deck of the fishing or bass boat. The trolling motor device according to the present invention is configured to be pivoted from a substantially horizontal resting or stowed position on top of the deck at the bow of the boat to a substantially vertical operating position for propelling the boat.

The trolling motor device according to the present invention includes a mounting unit connected to drive unit. Preferably, the drive unit is pivotally connected to the mounting unit. The mounting unit, for example, can include a mounting plates configured to be secured to the boat (e.g. upper surface of deck). The trolling motor device according to the present invention includes a drive unit that is extendable/retractable or telescoping to the change to length to facilitate lifting or lower and pivoting of the drive unit back and forth between the substantially horizontal non-operating resting or stowed position to the substantially vertical operating position. Specifically, the trolling motor device according to the present invention is configured so that the drive unit is retracted to a compacted configuration when the drive unit is being pivoted.

The retracted compact mode of the drive unit greatly facilitates the ease and convenience of a user pivoting the drive unit between these two basic positions (i.e. non-operating position and operating position). Further, the retracted compact mode of the drive unit significantly decreases the stowage space required on top of the deck for the trolling motor device (i.e. retracted compact mode of drive unit significantly interferes with less user operating space when the user is moving about the deck of the boat).

In a particularly preferred embodiment of the trolling motor device according to the present invention, the drive unit is moved from a fully retracted position to a fully extended position, or from a fully extended to a fully compacted position quickly in a fast continuous movement. For example, the drive unit includes a manual device or manual actuating device (e.g. cord, cable, spring, belt, pulley, gear, crank, lanyard) to manually extend or retract the drive unit in fast continuous movement. Alternatively, the drive unit is provided with automatic actuating device (e.g. hydraulic actuator, pneumatic actuator, electrical actuator, electro/magnetic actuator, powered rack and pinion) to move the drive unit between the extended position and retracted position, or from the retracted position to the extended position in a fast continuous movement. In a most preferred embodiment, the drive unit is provided with a powered actuating unit and control (e.g. remotely controlled on foot pedal, or on drive unit itself) to automatically retract/extend the drive unit in a fast continuous movement.

In the most preferred embodiment, the drive unit is automatically retracted/extended while being automatically pivoted both in a fast continuous movement. In this manner, the drive unit is retracting/extending during the pivoting phase so that the drive unit is at least partially extended or fully extended when the drive unit reaches the substantially vertical or horizontal position. Alternatively, the drive unit can be configured so that the drive unit automatically extends only after the drive unit is fully pivoted from the substantially horizontal position to the substantially vertical position, however, there will exist a longer deployment time from the resting or stowed non-operating position to the fully deployed operational position with the drive unit is fully extended. However, in the most preferred embodiment, the drive unit quickly and easily extends or retracts while the drive unit is pivoted in and out of the boat again to optimize and reduce the time and effort to move the drive unit back and forth between the non-operating and operating positions. In an even more preferred embodiment of the trolling motor device according to the present invention, the drive unit is both automatically retracted/extended and pivoted (e.g. by powered actuators) and configured so that the drive unit is both pivoting and extending or retracting simultaneously again to increase the speed and reduce the time of deployment into the water or resetting to the resting or stowed position.

The drive unit of the trolling motor device according to the present invention is configured to extend or retract in overall length. In a preferred embodiment, the drive unit is provided with an extendable and retractable drive unit housing connecting an upper powered steering unit to a lower drive unit. For example, the drive unit housing can include an inner housing unit slideable disposed within an outer housing unit to form a drive unit housing assembly (e.g. a smaller diameter shaft slideable disposed within a larger diameter shaft).

The extendable or retractable drive unit housing can be provided with an actuator for extending or retracting the length of the drive unit housing assembly. The actuator can be a manually operated actuator (e.g. cord, cable, screw drive with hand crank, belt, manually operated screw actuator, cog belt, pulley), or can be a powered actuator (e.g. hydraulic actuator, pneumatic actuator, electric actuator, electro-magnetic actuator, screw shaft). Alternatively, the drive unit can be configured to change in length by collapsing or folding in other manners versus a preferred telescoping arrangement.

The trolling motor device according to the present invention includes a mounting unit connected to a drive unit, preferably by a pivot connection. This arrangement allows the drive unit to be pivoted from a substantially horizontal storage position on the deck of the boat to a substantially vertical operational position. The trolling motor device according to the present invention also includes a control unit for controlling the steering, power on/off to the drive unit, and the level of power to the drive unit. Preferably, the control unit is a foot pedal control unit connected to the drive unit by a control cable.

In a preferred embodiment, the foot pedal control unit is connected to the drive unit by a movable steering cable contained within the control cable. Further, the foot pedal control unit includes electronic controls connected by electrical wires extending from the foot pedal control unit to the drive unit contained within the control cable to control power on/off to the drive unit, control forward/reverse, and control the level of power to the drive unit from the boat battery. Specifically, the boat battery (e.g. 12 volt marine battery) is connected to the foot pedal control by a power cable.

The mounting unit includes a mounting bracket secured to the deck of the boat (e.g. by screw fasteners). The drive unit can be directly pivotally connected to the mounting unit. More preferably, the mounting unit including a pair of mounting brackets, including one connected to the deck of the boat, and one connected to the drive unit. At least one support arm, preferably two (2) support arms, pivotally connect the two mounting brackets together. In this manner, the support arm(s) can swing almost one-hundred eighty degrees (180°) to lift and pivot the drive unit up and outwardly from the boat, or up and inwardly into the boat. The mounting unit is preferably connected at or adjacent the bow of the boat.

The drive unit includes an upper steering unit connected to an upper end of a drive unit housing, and a lower drive unit connected to a lower end of the drive unit housing. The drive unit housing is preferably a telescoping drive unit housing including two, three or more telescoping drive unit housing sections. In a preferred embodiment, the drive unit housing includes an upper housing unit with a lower housing unit slidably disposed within the upper unit housing. For example, the upper drive unit housing can be a larger size hollow shaft (e.g. cylinder), and the lower housing unit can be a smaller size hollow shaft (e.g. cylinder) slidably disposed within the larger diameter cylinder. The upper drive unit housing and/or the lower drive unit housing can have a traverse cross-sectional shape in the form of a circle, triangle, square, star, symmetrical, asymmetrical, or custom shaped such as the shape of an air foil to provide laminar flow about the drive shaft housing to reduce drag.

The drive unit housing can be configured so that both the upper drive unit housing and the lower drive unit housing turn together (i.e. upper drive unit housing is mechanically coupled to the lower drive unit housing while providing telescoping of the lower drive unit housing in and out of the upper drive unit housing). Alternatively, the upper drive unit housing can be independent of the lower drive unit housing (i.e. the upper drive unit housing is decoupled from the lower unit housing) requiring the lower drive unit housing to be directly connected to the steering mechanism or steering coupling. In the embodiment in which the upper drive unit housing is mechanically coupled to the lower drive unit housing, the upper drive unit housing can be directly connected to the steering mechanism or steering coupling, which in turn drives the lower drive unit housing.

Preferably, the upward drive unit housing is mechanically coupled to the lower drive unit housing throughout the travel of the lower drive unit housing in and out of the upper drive unit housing. In this manner, the steering registration between the upper drive unit housing and the lower drive unit housing is maintained throughout the travel up or down of the lower drive unit housing within the upper drive unit housing. Alternatively, the drive unit housing can be configured so that the upper drive unit housing and lower drive unit housing are not coupled during part of the travel of the lower drive unit housing up and down within the upper drive unit housing, and then become mechanically coupled during another portion of the travel there between. For example, the upper drive unit housing and the lower drive unit housing are decoupled when the lower drive unit housing is fully retracted within the upper drive unit housing, and then become coupled when the lower drive unit housing is partially or fully lowered or extended from the upper drive unit housing.

The upper steering unit is electrically connected to the lower drive unit by at least one, preferably two or three electrical wires. Preferably, the electrical wires are bundled together as a drive unit power cable (e.g. coiled flexible power cable) disposed with the drive unit housing to accommodate telescoping of the lower drive unit housing from the upper drive unit housing. Alternatively, the drive unit power cable can be provided on a spring biased reel or spool located within the drive unit (e.g. upper steering unit or lower drive unit) to accommodate the change in length of the drive unit power cable. The control cable located between the foot pedal control unit and the drive unit directs power from the boat battery to the upper steering unit and down through the drive unit power cable contained within the drive unit housing to the lower drive unit containing an electrical motor (e.g. 12 volt, 24 volt, 36 volt, DC electrical motor). Again, the control for power on/off and the control for the level of power is preferably controlled by the foot pedal control unit preferably provided on the deck of the boat.

The trolling motor device according to the present invention preferably includes a drive unit, including combined steering and telescoping features. In a preferred embodiment, the lower drive unit housing is preferably at least partially retracted up into the upper drive unit housing (i.e. at least partially compacted) prior to the step of lifting and pivoting the drive unit from a substantially vertical operational position into the boat and then situated in a substantially horizontal non-operational resting or stowed position laying on top of the deck of the boat. In this manner, the center of gravity of the drive unit is significantly moved upwardly due to the retraction of the lower drive unit housing into the upper drive unit housing. This greatly reduces the effort and force required to pivot the drive unit into the boat providing significant convenience to the user. Further, the space required for storing the compacted drive unit on the deck of the boat is significantly decreased (e.g. by one-half).

In a preferred embodiment of the trolling motor device according to the present invention, the lower drive unit housing is retracted into the upper drive unit housing manually (i.e. without the assistance of a powered device, drive or actuator) greatly simplifying the mechanism and mechanics involved with retracting the lower unit housing into the upper unit housing (e.g. by use of a rope, cable, lanyard, wire, rod, belt can be utilized for retracting the lower drive unit housing into the upper drive unit housing). For example, the lower end of a cable can be connected (inside or outside) to the lower housing unit, and an upper end of the cable can be provided with a gripping handle so that the user can lift up and retract the lower housing unit into the upper housing unit. The cable can be disposed within both the lower housing unit and the upper drive unit housing and come out of the upper steering unit, or the cable can be connected to the lower drive unit housing and connect with the mounting unit by bypassing the upper housing unit.

In other preferred embodiments of the trolling motor device according to the present invention, the lower drive unit housing is lifted up and retracted into the upper housing unit by providing a powered device, drive or actuator inside, or outside, or part of the drive unit or drive unit housing. The powered actuator provides for automatic or non-manual retraction of the lower drive unit housing into the upper drive housing. For example, the actuator can be a hydraulic actuator, pneumatic actuator, electric actuator, electro-magnetic actuator, powered rack and pinion, powered rack and worm gear, powered screw actuator, or some other suitable powered device, drive or actuator that can be located inside, outside and/or a part of the drive unit or drive unit housing.

The powered device, drive, or actuator can be controlled by a separate controller located on the drive unit (e.g. upper steering unit), or more preferably on the foot pedal control unit.

In a manually actuated embodiment of the trolling motor device according to the present invention, the lower drive unit housing is freely slidable within the upper drive unit housing. In this manner, when the cable is pulled by the user, the lower drive unit housing is lifted up and retracted into the upper unit housing, and upon further pulling of the cable by the user the drive unit is pivoted via the mounting unit into the boat in a fast continuous movement. To place the drive unit into operation, the user lifts up the upper steering unit while pushing outwardly to pivot the drive unit off the boat. As the drive unit pivots from a substantially horizontal position to a substantially vertical position the lower drive unit housing begins to freely slide and extend or telescope out of the upper drive unit housing under its own weight until fully extended. The weight of the lower drive unit maintains the lower drive unit housing fully extended from the upward drive unit housing during operation of the trolling motor device.

Optionally, the lower drive unit housing is locked in the fully extended position from the upper drive unit housing so there exists no chance of sliding movement between the upper drive unit housing and the lower drive unit housing during operation of the drive unit. The locking device can be a spring loaded pin, latch, lever, slide or some other suitable mechanical locking device. The locking device can be manually operated, or can be operated remotely by use of a linkage, rod, cable, electronic actuator, electro-mechanical actuator, hydraulic actuator, pneumatic actuator, or by some other suitable device for remotely releasing the locking device. Further, an additional locking device can be configured to also lock the lower drive unit housing into the upper drive unit housing when the lower drive unit housing is fully retracted within the upper drive unit housing. In this manner, the upper drive unit housing and lower drive unit housing are locked together during the pivoting operation in and out of the boat. This additional locking device can be operated manually or remotely as discussed above for the first locking device.

DETAILED DESCRIPTION OF PREFERRED EMBODIMENTS

Figure 1:
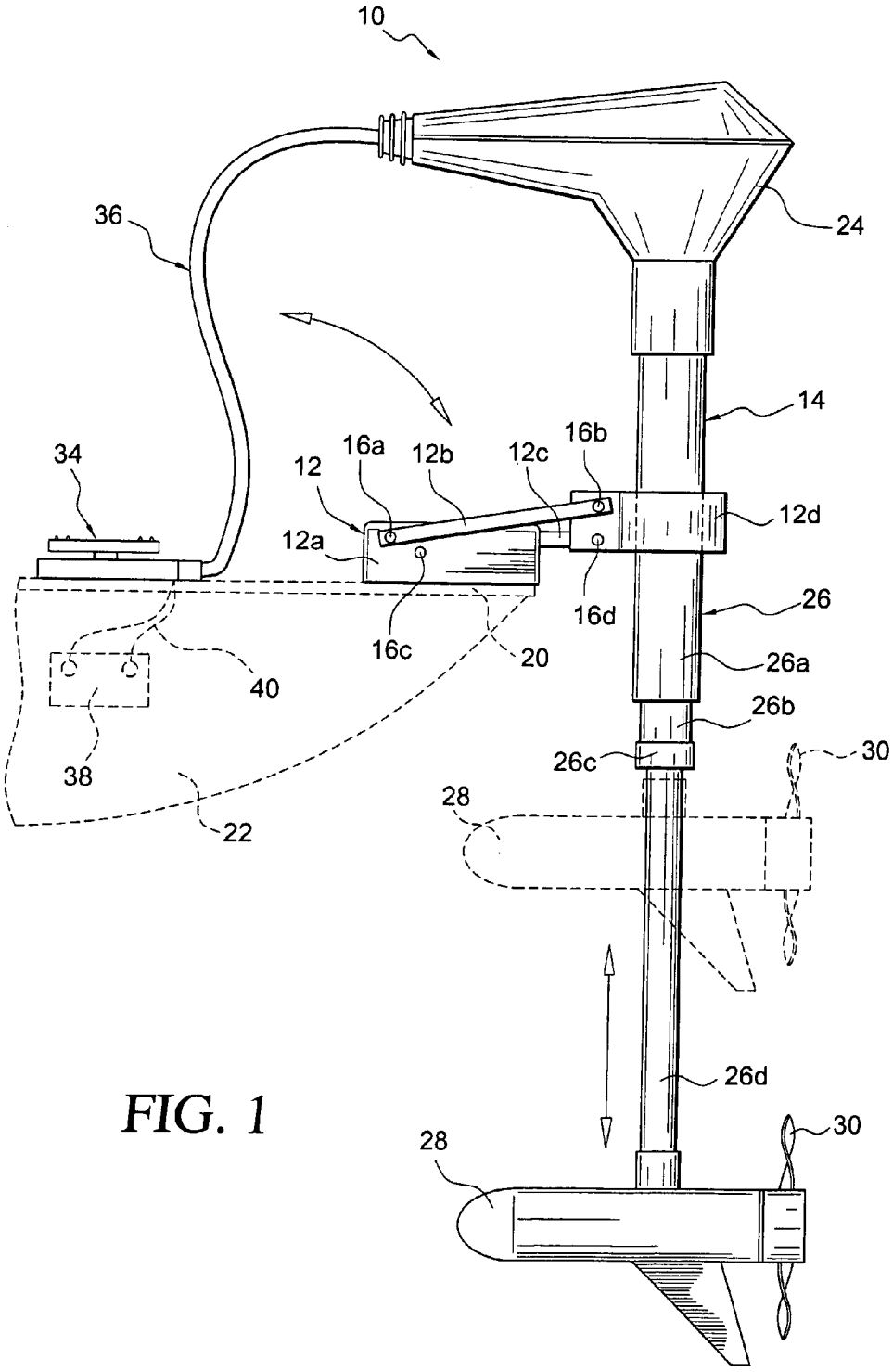
FIG. 1 is a side elevational view of a preferred embodiment of the trolling motor device according to the present invention.
Figure 2A:
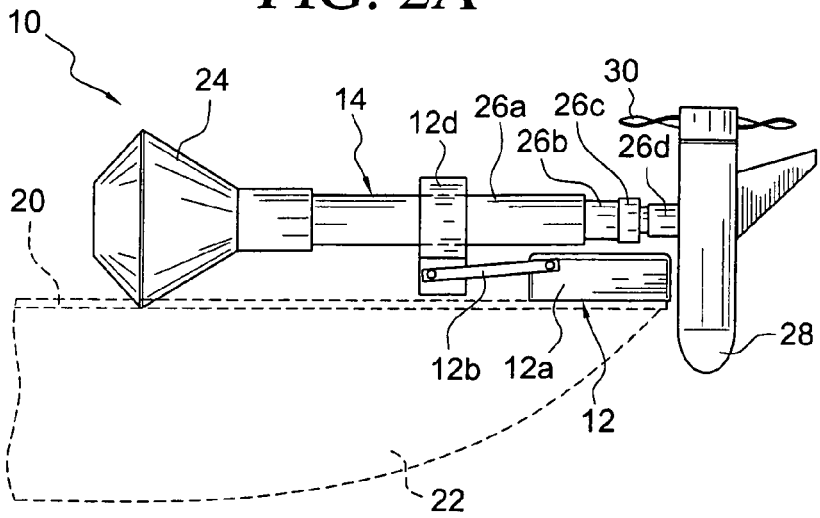
FIG. 2A is a side elevational view of the trolling motor device shown in FIG. 1, placed in a resting or stowed position.
Figure 2B:
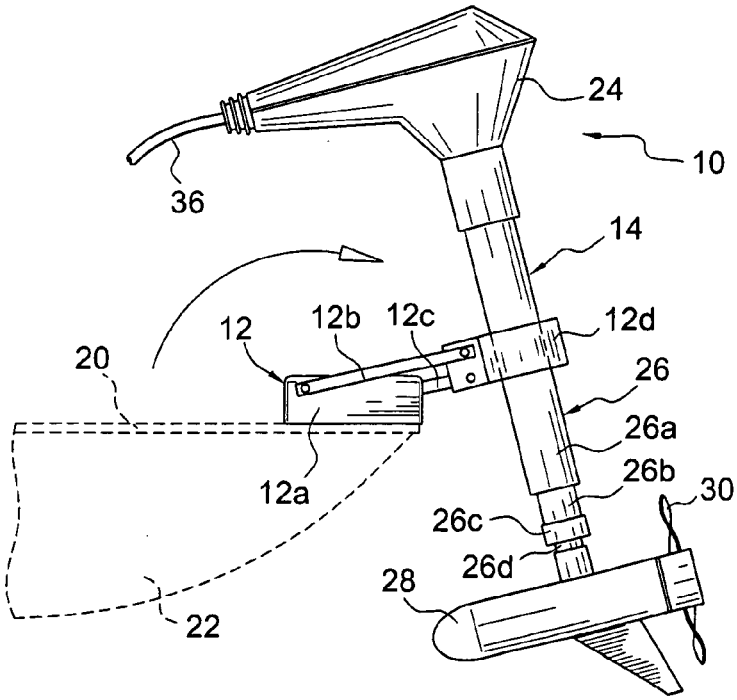
FIG. 2B is a side elevational view of the trolling motor device shown in FIG. 1, in a transitional position being pivot down towards an operational position.
Figure 2C:
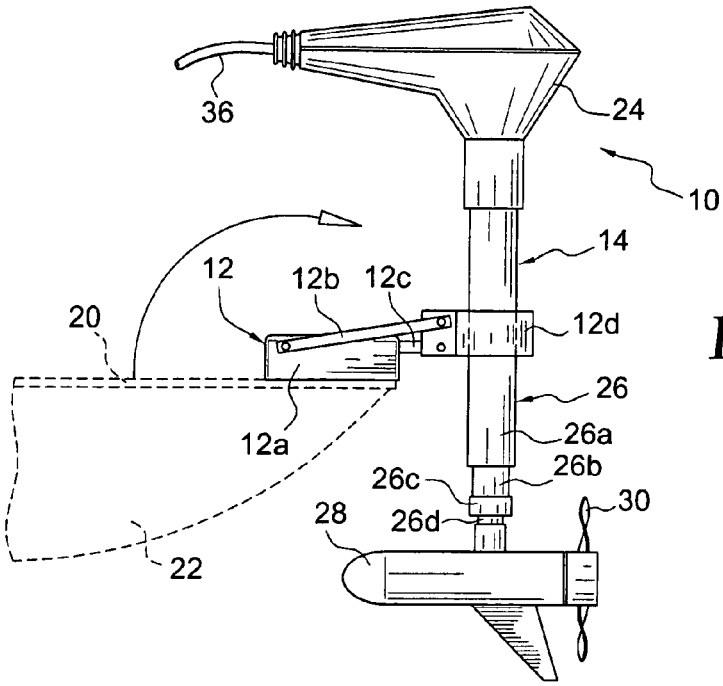
FIG. 2C is a side elevational view of the trolling motor device shown in FIG. 1, in an operational position with the lower drive unit in its upper most position or otherwise fully retracted position.
Figure 2D:
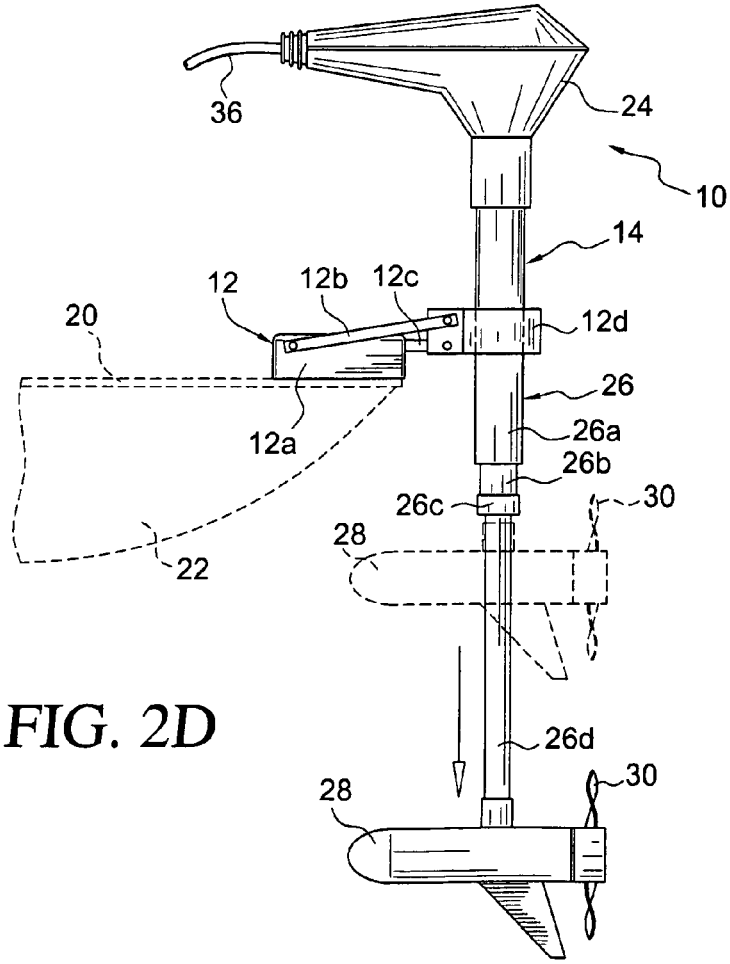
FIG. 2D is a side elevational view of the trolling motor device shown in FIG. 1, in an operational position with the lower drive unit in its lower most position or otherwise fully extended position.

A preferred embodiment of the trolling motor device 10 according to the present invention is shown in FIGS. 1–4.

The trolling motor device 10 includes a mounting unit 12 connected to a drive unit 14 by a pivotable connection 16. The mounting unit 12 includes a mounting plate 12*a* having a pair of inwardly extending flanges 12*b* to be secured by fasteners 18 (e.g. stainless or brass screws) to an upper surface of the deck 20 of the boat 22.

The drive unit 14 includes an upper steering unit 24 connected to an upper end of drive unit housing 26, and a lower drive unit 28 connected to a lower end of the drive unit housing 26. The upper steering unit 24 includes a rack and pinion arrangement for mechanically rotating the drive unit housing 26 for steering the boat 22. The lower drive unit 28 is fitted with a propeller 30, and includes an electric drive motor (e.g. 12 volt, 24 volt, 36 volt DC electric motor) for rotating or driving the propeller 30.

The trolling motor device 10 includes a boat battery 32 electrically connected to a foot pedal control unit 34. The foot pedal control unit 34 is electrically connected to the drive unit 14, in particular the upper power steering unit 24, by control cable 36. The foot pedal control unit 34 is configured to control the on/off, speed and polarity (i.e. forward or reverse) of the lower drive unit 28, and for also controlling the upper steering unit 24 for steering the boat 22.

Figure 3:
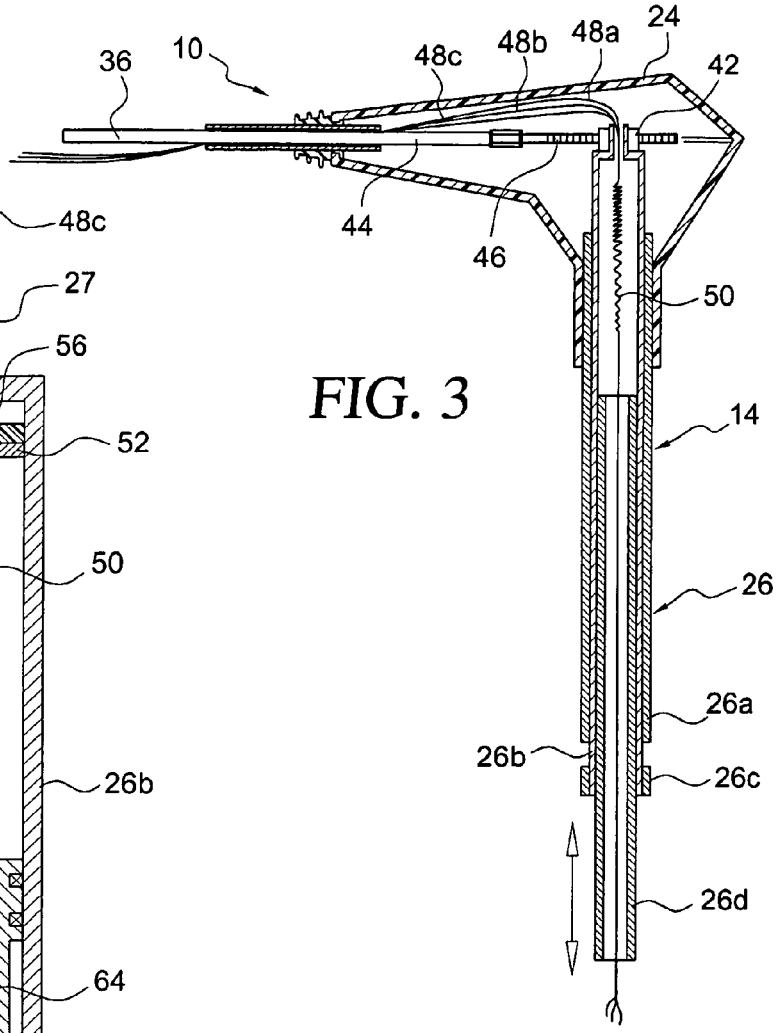
FIG. 3 is a partial and cross-sectional side elevational view of the trolling motor device shown in FIG. 1.
Figure 4:
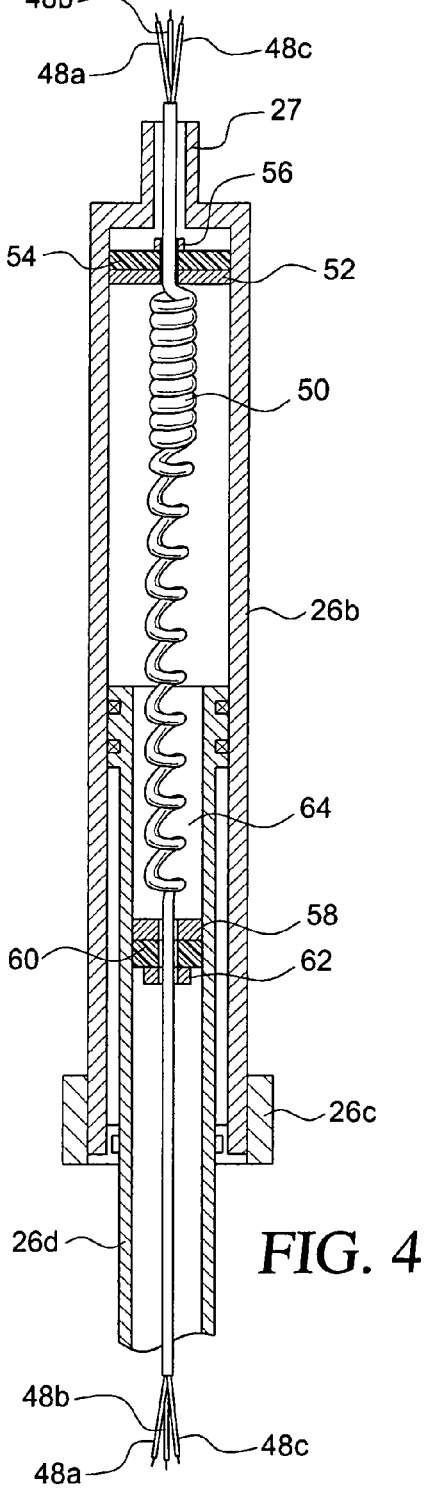
FIG. 4 is an exploded broken away partial and cross-sectional side elevational view of the trolling motor device shown in FIG. 1.

The detail construction of the trolling motor device 10 according to the present invention is shown if FIGS. 3 and 4.

The upper end of the upper drive unit housing 26*a* includes an extension 27 accommodating a gear 42 (FIG. 3). The control cable 36 includes a mechanical cable 44 having an end fitted with a rack 46 providing a rack and pinion arrangement with gear 42. The foot pedal control unit 34 moves the mechanical cable back and forth, and in turn moves the rack 46 back and forth acting on the gear 42 to rotate the upper drive unit housing 26*a* for steering the drive unit 14 by use of the foot pedal control unit 34.

The control cable 36 contains electrical wires 48*a*, 48*b*, 48*c*, extending between the foot pedal control unit 34 and the upper steering unit 24. The electrical wires 48*a*, 48*b*, 48*c* are contained within a drive unit power cable 50, which extends from the upper steering unit 24 through the drive unit housing 26 to the lower drive unit 28. The drive unit power cable 50 is preferably coiled to be extendable and retractable to change length to accommodate the change of length of the drive unit housing 26 (i.e. lower drive unit housing 26*b* retracting into upper drive unit housing 26*a*).

As shown in FIG. 1, the upper drive unit housing 26*a* is provided with a sealing plate 52, elastrometric seal 54 and cable fastener 56 for sealing and anchoring the upper end of the drive unit power cable 50 within the drive unit housing 26. The lower drive unit housing 26*b* is provided with a sealing plate 58, elastrometric seal 60 and a cable fastener 62 for sealing and anchoring a lower end of the drive unit power cable 50 within the lower drive unit housing 26*b*. The sealing plate 58 is located so as to provide a cavity 64 for accommodating the drive unit power cable 50 when the lower drive unit housing 26*b* is fully retracted into the upper drive unit housing 26*a*.

The lower drive unit housing 26*b* can be extended/retracted or otherwise telescoped from the upper drive unit housing 26*a* by manually or powered actuation. A variety of examples for telescoping the lower drive unit housing 26*b* in and out of the upper drive unit housing 26*a* are shown in FIGS. 5–10.

Figure 5:
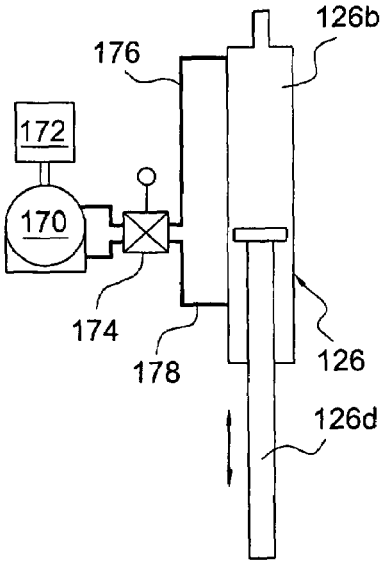
FIG. 5 is a diagrammatic side view of a drive unit housing hydraulically actuated.

In the embodiment shown in FIG. 5, the drive unit housing 126 is hydraulic actuated to drive the lower drive unit housing 126*b* into and out of the upper drive unit housing 126*a*. A hydraulic pump 170 is supplied with hydraulic fluid from reservoir 172. A hydraulic control unit 174 is connected between supply/return lines 176, 178 for controlling the upward and downward movement of the lower drive unit housing 126*b* in and out of the upper drive unit housing 126*a*.

Figure 6:
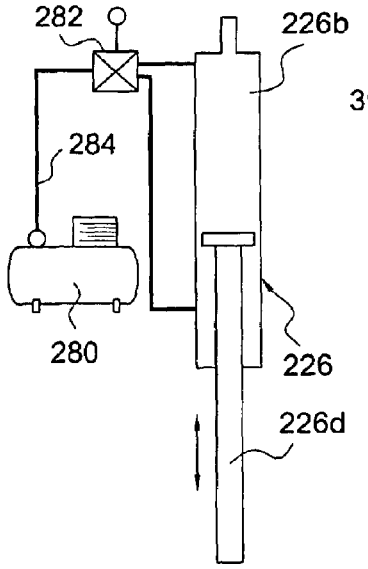
FIG. 6 is a diagrammatic side view of a drive unit housing pneumatically actuated.

In the embodiments shown in FIG. 6, the drive unit housing 226 is pneumatically actuated. An air compressor 280 is connected to pneumatic control unit 282 by a high pressure line 284. The pneumatic control unit 282 is connected to the drive unit housing 226 by supply/return lines 286, 288.

Figure 7:
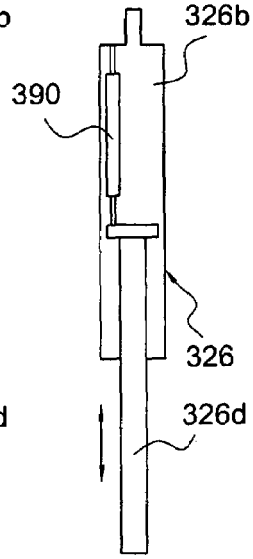
FIG. 7 is a diagrammatic side view of a drive unit housing actuated by a separate actuator.

In the embodiment shown in FIG. 7, the drive unit housing 326 is actuated by a separate powered actuator 390. The powered actuator 390 can be a hydraulic actuator, a pneumatic actuator, an electric actuator, or electro-magnetic actuator. Further, the powered actuator 390 is shown disposed within the drive unit housing 326, however, alternatively the actuator 390 can be located outside or as a part of the drive unit housing 326 itself.

Figure 8:
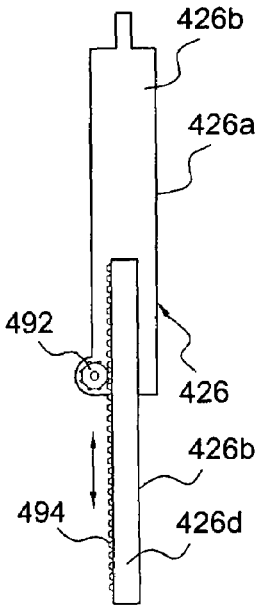
FIG. 8 is a diagrammatic side view of a drive unit housing actuated by a rack and pinion arrangement.

In the embodiment shown in FIG. 8, the upper drive unit housing 426*a* is provided with a pinion 492 cooperating with a rack 494 provided on the lower drive unit housing 426*b*. The pinion 492 can be manually actuated or powered actuated directly or remotely.

Figure 9:
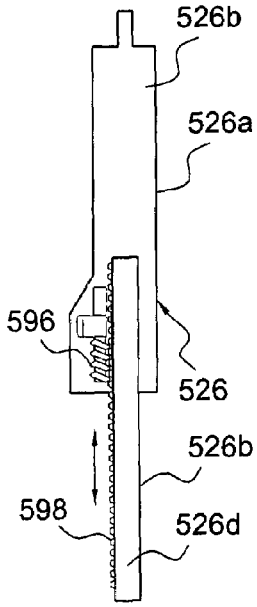
FIG. 9 is a diagrammatic side view of a drive unit housing actuated by a rack and worm gear arrangement.

In the embodiment shown in FIG. 9, the upper drive unit housing 526*a* is provided with a worm gear drive 596 and the lower drive unit housing 526*b* is provided with a rack 598. The worm gear drive 596 can be manually or power actuated directly or remotely.

Figure 10:
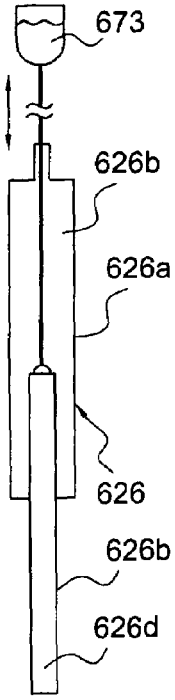
FIG. 10 is a diagrammatic side view of a drive unit housing manually actuated by a cable and handle.

In the embodiment shown in FIG. 10, a cable 671 is connected at its lower end to the lower drive unit housing 626*b*, and extends upwardly through the upper drive unit housing 626*a*. An upper end of the cable 671 is provided with a handle 673 to raise and lower the lower drive unit housing 626*b* within the upper drive unit housing 626*a*.

I claim:

1. A bow mounted trolling motor device for a boat configured for propelling and steering the boat on water, said device comprising:

a bow mounting unit configured to connect to the bow of the boat;

a drive unit connected to said mounting unit, said drive unit including:

an upper steering unit connected to an upper end of a drive unit housing;

a lower drive unit connected to a lower end of said drive unit housing, said lower drive unit including an electrical motor driving a propeller, said drive unit being configured to substantially change in length between a fully extended position and a fully retracted position; and an adjustable length drive unit power cable extending between said upper steering unit and said lower drive unit and accommodated within said drive unit housing;

a foot pedal control unit mechanically and electrically connected by a control cable to said upper steering unit of said drive unit, said foot pedal control unit configured to steer said drive unit and control electrical power to said lower drive unit;

a pivotal connection provided between said bow mounting unit and said drive unit, said pivotal connection configured to allow said fully collapsed drive unit to pivot between a fully raised resting position on a deck of the boat to a fully down position;

an actuating device configured to fully extend and retract said drive unit; and a boat battery electrically connected to said foot pedal control unit to supply power to said drive unit.

2. A device according to claim 1, including an electrically actuated and controlled trim mechanism configured to selectively adjust the height of said lower drive unit once said drive unit is placed in its fully extended position.

3. A device according to claim 1, wherein drive unit housing is a shaft.

4. A device according to claim 1, wherein said drive unit housing is configured to be extended or retract to extend and retract said drive unit.

5. A device according to claim 4, wherein said drive unit housing including an upper larger diameter shaft and a lower small diameter shaft slidably disposed within said upper larger diameter shaft.

6. A device according to claim 1, wherein said drive unit and mounting unit are configured to simultaneously extend/retract said drive unit while rotating said drive unit.

7. A device according to claim 1, wherein said actuating device is a manually operated actuating device.

8. A device according to claim 7, wherein said actuating device is a cable.

9. A device according to claim 7, wherein said actuating device is a cord.

10. A device according to claim 1, wherein said actuating device is a powered actuating device.

11. A device according to claim 10, wherein said actuating device is a hydraulic actuator.

12. A device according to claim 10, wherein said actuating device is a pneumatic actuator.

13. A device according to claim 10, wherein said actuating device is an electric actuator.

14. A device according to claim 10, wherein said actuating device is an electro-mechanical actuator.

15. A device according to claim 10, wherein said actuating device is a separate powered actuating device.

16. A device according to claim 12, wherein a lower end of said cord is connected to said lower drive unit housing and an upper end of said cord is connected to a handle for raising and lowering said lower drive unit housing into and out of said upper drive unit housing.

17. A device according to claim 16, wherein said cord is disposed with in said drive unit housing.

18. A device according to claim 16, wherein said cord is located outside said drive unit housing.

* * * * *